United States Patent [19]

Götzen

[11] 4,057,278

[45] Nov. 8, 1977

[54] MULTI-SHELL GRAB BUCKET

[75] Inventor: Heinrich Götzen, Wetter, Germany

[73] Assignee: Heinrich Götzen Maschinenbau, Germany

[21] Appl. No.: 692,727

[22] Filed: June 4, 1976

[30] Foreign Application Priority Data

June 6, 1975 Germany ..... 2525152

[51] Int. Cl.[2] ..... B66C 3/16

[52] U.S. Cl. ..... 294/88; 294/106

[58] Field of Search ..... 294/70, 71, 88, 106, 294/107, 120; 37/182, 183 R, 186, 187, 188; 214/147 G, 656, 657

[56] References Cited

U.S. PATENT DOCUMENTS

| | | | |
|---|---|---|---|
| 2,652,280 | 9/1953 | Billings | 294/88 |
| 3,413,029 | 11/1968 | Donovan | 294/88 X |
| 3,795,421 | 3/1974 | Vohl et al. | 294/88 |

FOREIGN PATENT DOCUMENTS

| | | | |
|---|---|---|---|
| 223,780 | 11/1961 | Austria | 294/88 |
| 1,315,962 | 12/1962 | France | 294/88 |
| 970,205 | 8/1958 | Germany | 294/88 |
| 920,977 | 3/1963 | United Kingdom | 294/88 |

*Primary Examiner*—Johnny D. Cherry
*Attorney, Agent, or Firm*—Robert E. Burns; Emmanuel J. Lobato; Bruce L. Adams

[57] ABSTRACT

A multi-shell grab bucket apparatus comprises a distributor head having a plurality of engine cylinder chambers rigidly fixed with respect to the distributor head and being disposed in a common horizontal plane and extending radially outwardly from and angularly spaced about the distributory head center axis. Engine pistons are mounted for sliding reciprocatory movement within respective ones of the engine cylinder chamber and define therewith double-acting reciprocating engines. A set of fluid supply passages located internally of the distributor head are connectable to an external source of fluid pressure medium for supplying the medium to opposite ends of the engine cylinder chambers to effect reciprocation of the engine pistons to thereby actuate scoops connected to respective ones of the engine pistons.

9 Claims, 7 Drawing Figures

MULTI-SHELL GRAB BUCKET

BACKGROUND OF THE INVENTION

The invention relates to a multi-shell grab bucket having a distributor head arranged beneath a suspension loop, whereby the distributor head carries mountings for the coupling of scoops arranged in a circular distribution as well as associated double-acting reciprocating fluid engines also distributed in a circular manner and arranged between the distributor head and the scoops and which has two supply lines connected with external connections for the supply of a pressure medium and to which are connected radially extending supply bores.

In the heretofore known construction, the reciprocating engines are coupled firstly to the scoops and secondlyto the mountings thereof or to the distributor head, so as to be able to follow the rotating movements on operating the scoops. Therefore pressure hoses are necessary and which are connected to the supply bores of the distributor head and carry the pressure medium to the reciprocating engines. This involves considerable maintenance because the pressure hoses wear and are often damaged under the severe operating conditions to which multi-shell grab buckets are exposed. Economic operation is also detrimentally affected by the time during which the equipment is out of operation due to maintenance. Finally, the pressure hoses represent a source of danger. Thus, in the case of damage, not only can one of the scoops open but the operating pressure can drop to such an extent that the picked up load is released from the multi-shell grab bucket.

BRIEF SUMMARY OF THE INVENTION

The objective of the invention is therefore to improve the operating reliability and economic operation of the multi-shell grab bucket and to overcome the problems and disadvantages of prior constructions as defined hereinbefore.

According to the invention, a multi-shell grab bucket employs reciprocating engines whose cylinder chambers are rigidly connected with the distributor head and the supply bores for supplying the pressure medium are located in the walls of the reciprocating engines. Thus, the supply bores can be directly connected with the cylinder chambers of the reciprocating engines through the walls. Pressure hoses between the distributor head and the reciprocating engines are not needed thereby reducing maintenance and operating costs as well as eliminating hose breakage or rupture as one source of operational accidents.

Preferably, the reciprocating engines are constructed in one piece with the distributor head. This leads to a compact radial component, which reduces the danger of sticking in operation.

It is also advantageous for the scoops to be coupled to the reciprocating engines. Thus, the reciprocating engines simultaneously serve as mountings, which further simplifies construction.

It is also possible to couple the piston rods of the reciprocating engines with the scoops via sliding connections. However, it is more advantageous to couple cover plates to the piston rods of the reciprocating engines and these cover plates are in turn connected in an articulated manner with the associated scoops.

This construction compensates or the fact that during the operation of the scoops, the reciprocating engines no longer follow the rotating movements.

According to the invention, a first supply line is constructed as a ring main from which emanate supply bores which lead to the outer ends of the reciprocating engines. These supply bores are relatively short and do not have to be passed through the central area of the apparatus. In general, these supply bores are arranged parallel to the cylinder walls are connected to the cylinder chambers via transverse bores.

The supply bores emanating from a second supply line preferably pass through the faces of the cylinder chambers to the inner ends of the reciprocating engines. This leads to direct and very short connecting channels.

According to a particularly preferred feature of the invention, the first supply line is of ring shape and the second supply line is constructed as a central chamber. The position of the individual supply bores can be completely arbitrary. The central chamber also saves weight.

Due to the hose-less construction with the resulting reduction of danger, it is possible to develope the multi-shell grab bucket for more maneuverable, mobile and varied operation. Thus, it is desirable to make the multi-shell grab bucket rotatable. This necessarily leads to a danger of the multi-shell grab bucket striking against something. As extraneous contact is now permitted, the advantages of rotatability can be fully utilised, without involving further disadvantages.

As a further development of the invention between the suspension loop and the distributor head, a rotary head is provided in which a vertical shaft carrying the distributor head is hydraulically rotatably mounted. This rotary drive can be constructed in an extremely space-saving manner and is therefore adapted to the compact construction of the distributor head.

According to the invention, an annulus is formed in the rotary head between the shaft and the lateral casing and the annulus is subdivided into two chambers sealed relative to one another by a stop fixed to the casing and a piston fixed to the shaft on either side of the stop fixed to the casing is provided a wall bore with an external connection for the supply of pressure medium. Thus, the shaft can rotate in either direction relative to the casing unitl the piston engages the stop. In their contact surfaces the stop and piston have recesses, so that there is always a residual chamber which is subject to pressure action by the associated connection for as long as the shaft is to be rotated in the opposite direction.

BRIEF DESCRIPTION OF THE DRAWINGS

Other and further objects of the present invention will be apparent from the following description and claims when read in conjunction with the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made if desired by those skilled in the art without departing from the invention and the scope of the appended claims. In the drawings:

DETAILED DESCRIPTION OF THE PREFERRED EMBODIMENTS

Figure 1:
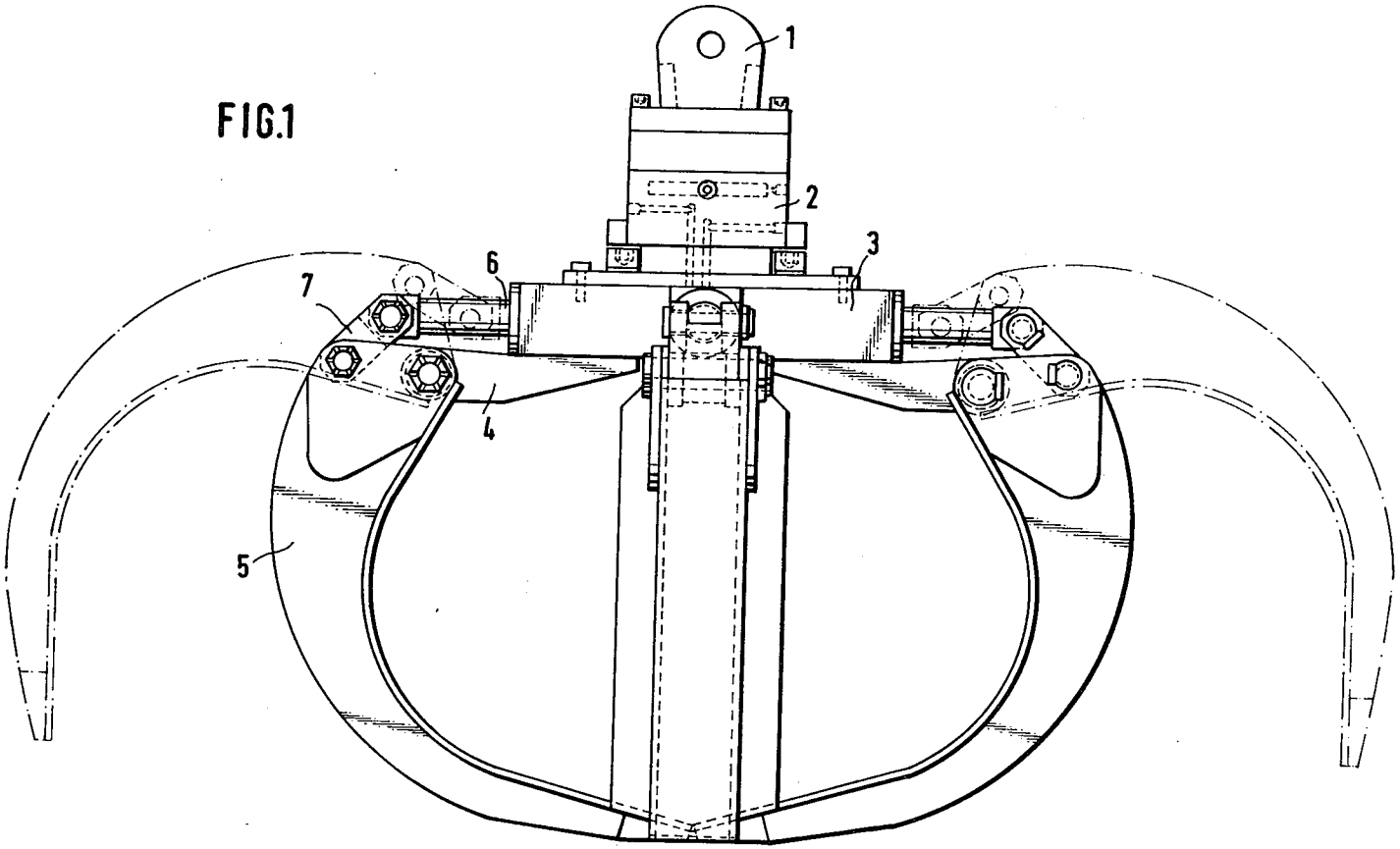
FIG. 1 is a side view of the multi-shell grab bucket.

According to FIG. 1 the multi-shell grab bucket has a suspension loop 1 which is screwed to a rotary head 2. Beneath the rotary head is located a distributor head 3 to which are coupled five scoops 5, with the interpositioning of plates 4. Reciprocating engines located within the distributor head are connected to actuate the scoops and as shown in the drawing the piston rods 6 of the reciprocating engines are connected to the scoops via cover plates 7 which are articulated on either side.

Figure 2:
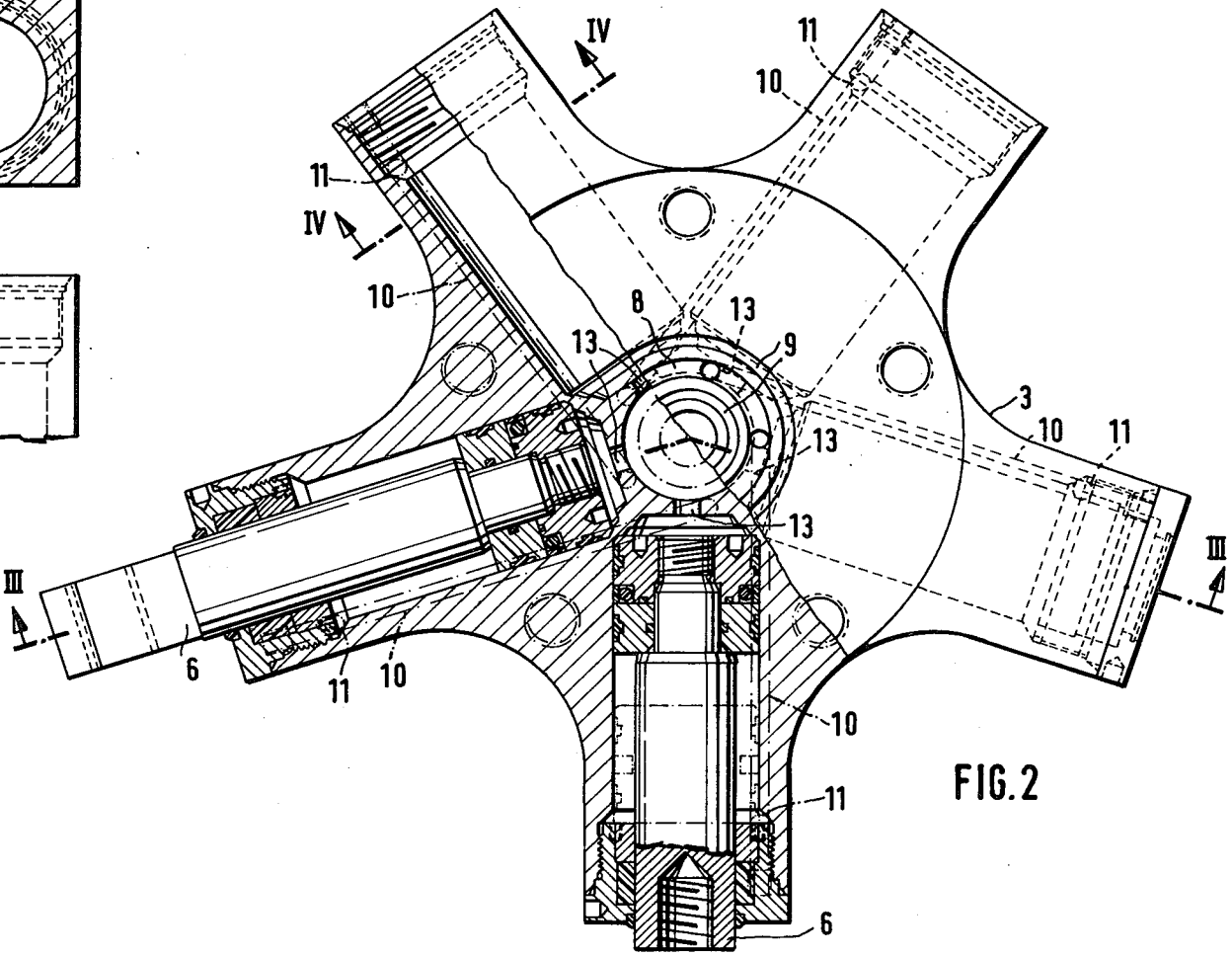
FIG. 2 is a plan view, partly in section of the distributor head containing the reciprocating engines and with the rotary head and the suspension loop removed.
Figure 4:
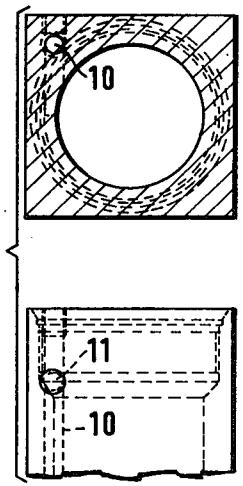
FIG. 4 is a section view taken along the line IV—IV of FIG. 2.
Figure 3:
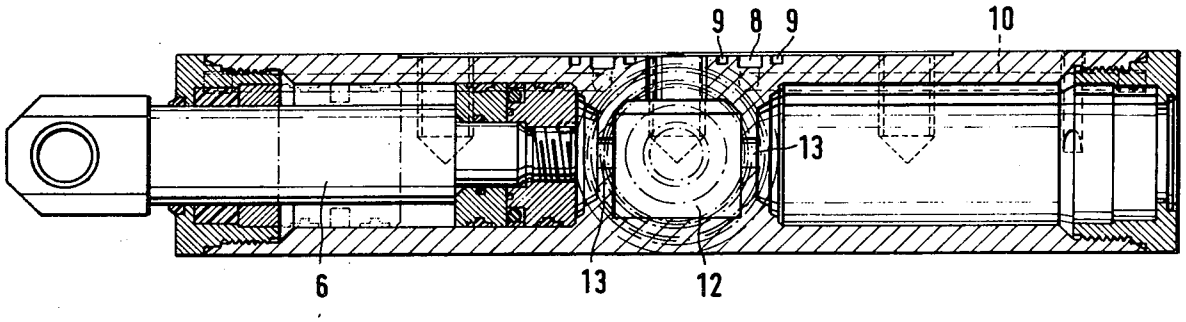
FIG. 3 is a section view taken along the line III—III of FIG. 2.

According to FIGS. 2 and 3 the distributor head has a first supply line 8 in the form of a ring main. The ring main is incorporated into the upper surface of the distributor head and slots 9 are provided on either side of the supply line 8 for receiving gaskets. First supply bores 10 which lead to the outer ends of the reciprocating engines are connected with the first supply line 8. Transverse bores 11 interconnect the outer ends of the bores 10 to the cylinder chambers.

FIG. 3 in particular shows that the distributor head 3 also has a second supply line 12 in the form of a central chamber. Second supply bores 13 are connected to this chamber and at the front lead directly into the cylinder chambers.

Figure 5:
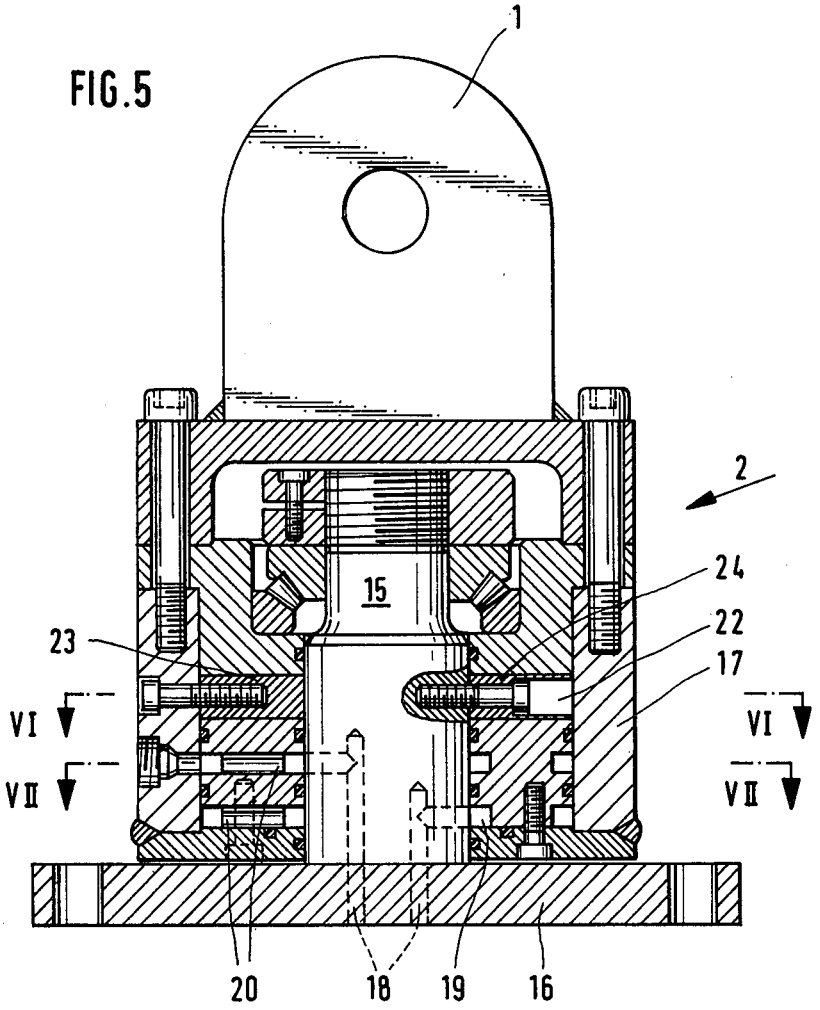
FIG. 5 is a section view through the rotary head and suspension loop.
Figure 7:
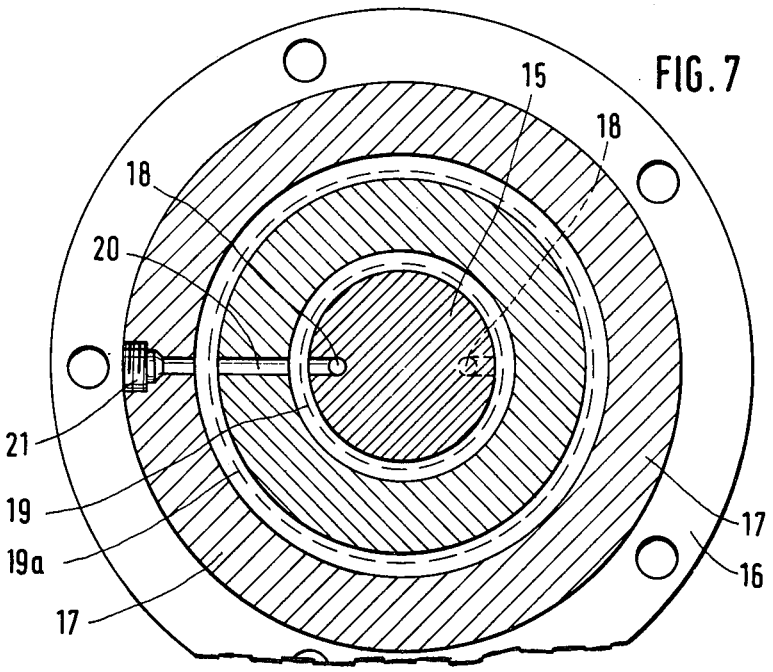
FIG. 7 is a section view taken along the line VII—VII of FIG. 5.

The rotary head 2, shown in detail in FIG. 5, is screwed to the distributor head 3, with the interpositioning of the intermediate plate shown in FIG. 1. The intermediate plate is always in use, no matter whether the distributor head 3 is connected to the suspension loop 1 with or without the rotary head 2. Rotary head 2 has a shaft 15 connected to a plate 16 and the shaft 15 is mounted for rotary movement within a casing 17. The casing 17 is in turn screwed to the suspension loop 1. The dimensions of shaft 15 are selected in such a way that the shaft cross- section covers both supply lines 8 and 12 of the distributor head. Within the shaft, connecting bores 18 are provided and arranged such that one opens into the first supply line 8 and the other into the second suply line 12. The connecting bores 18 terminate at the lateral surface of the shaft and communicate with annular slots which pass round the casing surface and which lead to external connections 21 (FIG. 7) either directly via wall bores 20 or via further slots 19*a*.

Figure 6:
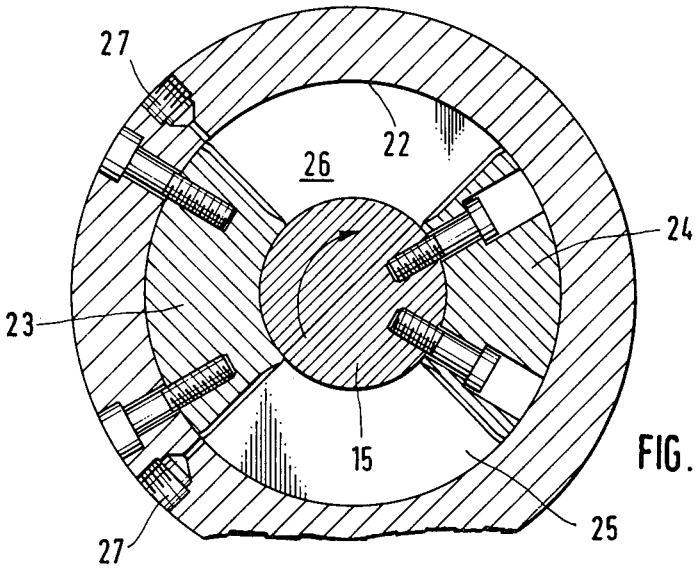
FIG. 6 is a section view taken along the line VI—VI of FIG. 5.

An annulus 22 (FIG. 6) is also formed within casing 17. A stop member 23 fixed to the casing and a piston 24 fixed to the shaft 15 subdivide this annulus into two reciprocally sealed chambers 25 and 26. External connections 27 are provided on either side of the stop 23 fixed to the casing, for supplying the pressure medium to actuate the piston 24. This arrangement permits shaft 15 to be rotated relative to casing 17.

The invention is not limited to the embodiments described and represented hereinbefore, and various modifications can be made thereto within the scope of the invention.

What is claimed is:

1. In a multi-shell grab bucket apparatus: a distributor head having a plurality of engine cylinder chambers rigidly fixed with respect to said distributor head and disposed in a common plane and extending radially outwardly from and angularly spaced about a center axis, engine pistons mounted for sliding reciprocatory movement within respective ones of said engine cylinder chamber and defining therewith double-acting reciprocating engines, and means defining fluid supply passages internally of said distributor head for supplying a fluid pressure medium to opposite ends of said engine cylinder chambers to effect reciprocation of the engine pistons; a plurality of actuatable scoops connected to respective ones of said engine pistons such that reciprocation of said engine pistons effects actuation of said scoops; and means connected to said distributor head for enabling suspension thereof from a boom, said means for enabling suspension of said distributor head including means connectable to an external source of fluid pressure medium for supplying the medium to said fluid supply passages located internally of said distributor head to effect actuation of said scoops.

2. A multi-shell grab bucket apparatus according to claim 1; wherein said engine cylinder chambers are constructed as a one-piece body with said distributor head.

3. A multi-shell grab bucket apparatus according to claim 1; further including cover plates articulated to the piston rods of the respective reciprocating engines and articulated to the respective scoops.

4. A multi-shell grab bucket apparatus according to claim 1; wherein said means defining fluid supply passages comprises a first supply line constructed as a ring main and from which emanates supply bores leading to the radially outer ends of said engine cylinder chambers.

5. A multi-shell grab bucket apparatus acccording to claim 4; wherein said supply bores are connected via transverse bores with the engine cylinder chambers.

6. A multi-shell grab bucket apparatus according to claim 4; wherein said means defining fluid supply passages comprises a second supply line from which emanates supply bores extending through the radially inner end walls of said engine cylinder chambers.

7. A multi-shell grab bucket apparatus according to claim 6; wherein said first supply line is concentric with respect to said center axis and said second supply line comprises a central chamber located at the center of said distributor head.

8. A multi-shell grab bucket apparatus according to claim 1; further including a rotary head interposed between said distributor head and said means for enabling suspension thereof and in which is hydraulically rotatably mounted a vertical shaft carrying said distributor head.

9. A multi-shell grab bucket apparatus according to claim 8; wherein said rotary head comprises a casing rigidly connected to said means or enabling suspension of said distributor head and enclosing said shaft, means in said casing defining an annulus encircling said shaft and being subdivided into two reciprocally sealed chambers by a stop member fixed to said casing and by a piston fixed to said shaft, and wherein said means for supplying the fluid pressure medium to said fluid supply passages comprises lateral bores extending through said casing on either side of said stop member for external connection to the source of fluid pressure medium.

* * * * *